US009498870B2

(12) United States Patent
Davis

(10) Patent No.: US 9,498,870 B2
(45) Date of Patent: Nov. 22, 2016

(54) MULTIPURPOSE BICYCLE TOOL

(71) Applicant: TITAN PRODUCT DEVELOPMENT, LLC, Chicago, IL (US)

(72) Inventor: Brian Williams Davis, Appleton, WI (US)

(73) Assignee: TITAN PRODUCT DEVELOPMENT, LLC, Chicago, IL (US)

( * ) Notice: Subject to any disclaimer, the term of this patent is extended or adjusted under 35 U.S.C. 154(b) by 617 days.

(21) Appl. No.: 13/975,531

(22) Filed: Aug. 26, 2013

(65) Prior Publication Data

US 2015/0052686 A1 Feb. 26, 2015
US 2015/0183101 A9 Jul. 2, 2015

Related U.S. Application Data

(60) Provisional application No. 61/701,748, filed on Sep. 17, 2012.

(51) Int. Cl.

| | |
|---|---|
| ***B25B 23/00*** | (2006.01) |
| ***B25B 13/00*** | (2006.01) |
| ***B25B 23/16*** | (2006.01) |
| ***B25B 27/00*** | (2006.01) |
| ***B25F 1/02*** | (2006.01) |
| ***B25G 1/00*** | (2006.01) |
| ***B25B 13/56*** | (2006.01) |
| ***B25B 15/02*** | (2006.01) |
| *B25B 15/00* | (2006.01) |

(52) U.S. Cl.

CPC ..... *B25B 27/0071* (2013.01); *B25B 13/005* (2013.01); *B25B 13/56* (2013.01); *B25B 15/02* (2013.01); *B25F 1/02* (2013.01); *B25G 1/005* (2013.01); *B25B 15/001* (2013.01)

(58) Field of Classification Search

CPC . B25B 13/005; B25B 27/0071; B25B 15/02; B25G 1/005; B25G 1/043; B25G 1/063; B25F 1/02

USPC ..... 81/124.3, 177.5, 439, 125.1; 7/167; 224/255, 904

See application file for complete search history.

(56) References Cited

U.S. PATENT DOCUMENTS

| | | | | | |
|---|---|---|---|---|---|
| 2,549,910 | A * | 4/1951 | Lane | B25G 1/043 | 81/177.5 |
| 2,793,377 | A | 5/1957 | Ashton | | |
| 2,870,809 | A * | 1/1959 | Feldman | B25G 1/005 | 81/177.5 |
| 2,968,980 | A | 1/1961 | Zierold | | |
| 3,416,395 | A * | 12/1968 | Hanson | B25B 23/065 | 81/125 |
| 3,561,510 | A * | 2/1971 | Johnson | B25G 1/005 | 81/177.5 |
| 4,399,723 | A * | 8/1983 | Marleau | B25G 1/085 | 81/437 |
| 4,827,812 | A * | 5/1989 | Markovetz | B25B 15/02 | 81/177.4 |
| 4,934,221 | A | 6/1990 | Hsiao | | |
| 5,086,674 | A * | 2/1992 | Her | B25B 13/06 | 7/138 |
| 5,442,982 | A * | 8/1995 | Bell | B25B 15/02 | 7/165 |
| 5,577,426 | A * | 11/1996 | Eggert | B25B 23/12 | 81/125 |
| 5,579,668 | A * | 12/1996 | Kozak | B25F 1/02 | 81/438 |
| 5,685,207 | A | 11/1997 | Hubert | | |
| 6,260,452 | B1 | 7/2001 | Yu | | |
| 6,378,402 | B1 | 4/2002 | Kalomeris et al. | | |

(Continued)

*Primary Examiner* — Bryan R Muller
(74) *Attorney, Agent, or Firm* — Justin Lampel

(57) ABSTRACT

The tool includes a body having an aperture disposed transversely there-through and tool bits disposed at either end. In use two tools are mated together by disposing the end of one tool through the aperture of another, thereby forming a tool having an operative portion and a torque handle.

6 Claims, 4 Drawing Sheets

(56) References Cited

U.S. PATENT DOCUMENTS

| | | | | |
|---|---|---|---|---|
| 6,941,842 | B1 | 9/2005 | Liou | |
| 6,945,145 | B1 | 9/2005 | Kesinger | |
| 7,040,200 | B2 | 5/2006 | Lin | |
| 7,228,766 | B1 * | 6/2007 | Shyu | B25B 13/005 81/125.1 |
| 7,278,644 | B2 | 10/2007 | Villarreal | |
| 7,331,261 | B2 * | 2/2008 | Blizniuk | B25B 23/0035 81/124.4 |
| 7,340,984 | B2 * | 3/2008 | Hsieh | B25B 13/06 81/125.1 |
| 7,494,304 | B2 | 2/2009 | McAuliffe | |
| 2003/0188609 | A1 * | 10/2003 | Crawley | B25B 7/02 81/439 |
| 2005/0252348 | A1 * | 11/2005 | Ting | B25B 13/06 81/177.5 |
| 2006/0032345 | A1 * | 2/2006 | Crawley | B25B 7/02 81/439 |
| 2011/0088522 | A1 * | 4/2011 | Floyd | B25B 15/00 81/438 |
| 2013/0014616 | A1 * | 1/2013 | Putsch | B25B 13/005 81/121.1 |

* cited by examiner

MULTIPURPOSE BICYCLE TOOL

PRIOR APPLICATIONS

This application claims priority to Provisional U.S. Patent Application No. 61/701,748, filed Sep. 17, 2012, the contents of which are hereby incorporated by reference.

BACKGROUND

Bicycles typically have several different types and sizes of fasteners, therefore cyclists typically carry a tool having a variety of tools and bits for different working requirements. Because it is inconvenient to carry a variety of tools and bits the art is replete with examples of tool kits having multiple tool means for adjusting the various fasteners found on a bicycle. Moreover, because space is often limited on a bicycle and users prefer not to carry several tools on their person, the art has focused primarily on folding tools that are compact, but often heavy and difficult to use, particularly when attempting to apply torque to a fastener. Thus, there remains a need for a tool that is useful for different working requirements and is also, light-weight, compact and provides sufficient torque in-use.

SUMMARY

Overcoming the limitations of the prior art, the present disclosure provides a simple, elegant, light-weight multi-purpose hand tool and kit that is particularly well suited for adjusting a fastener on a bicycle. While the tool is particularly well suited for adjusting a fastener on a bicycle it is to be understood that it use is not so limited. The tool and kits disclosed herein may be useful in adjusting any fastener.

The tool provides multiple portions for performing certain essential bicycle repair or maintenance functions, without being unusually complex or expensive to construct. Accordingly, in one preferred embodiment, the tool provides both an operative tool for adjusting a fastener and a torque handle.

In another embodiment the present disclosure provides a multi-purpose hand tool comprising a body having a midpoint, a first end and a second end, an aperture extending transversely through the body and a tool bit at the first or second end. The tool bit may be integrally formed with the body or may be separately formed and received by a tool bit socket disposed at the first or second ends. In a particularly preferred embodiment both the first and second ends comprise a tool bit.

In other embodiments the present disclosure provides a multi-purpose hand tool comprising a body having a midpoint, a first end and a second end, an aperture extending transversely through the body, the first or second end having a tool bit receiving socket and a tool bit disposed within the socket.

In other aspects the present disclosure provides a multi-purpose hand tool comprising a first tool having a body having a midpoint, a first end and a second end, an aperture extending transversely through the body; the first or second end having a tool bit receiving socket and a tool bit disposed within the socket; a second tool having a body having a midpoint, a first end and a second end, an aperture extending transversely through the body; the first or second end having a tool bit receiving socket and a tool bit disposed within the socket; wherein the first end of the first tool is disposed in the aperture of the second tool when the multi-purpose tool is arranged in an operative position.

In other aspects the present disclosure provides a tool kit comprising two multi-purpose hand tools and a retention mechanism, wherein each tool comprises a body having a first end and a second end, the first or second end having a tool bit receiving socket and a tool bit disposed within the socket, and an aperture extending transversely through the body.

In other aspects the present disclosure provides a tool kit comprising two or more multi-purpose hand tools and a retention mechanism selected from the group consisting of an o-ring, a strap and buckle, a pin and a strap and a magnet.

In yet other aspects the present disclosure provides a method of using a combination tool assembly to manipulate a work pierce comprising the steps of disposing the first end of a first tool through the aperture of a second tool whereby the second tool forms a torque handle, grasping the torque handle for manipulation of the first tool, and engaging the bit end of the first tool with a work piece to be manipulated.

In still other embodiments the disclosure provide a method of stowing a tool assembly comprising the steps of providing a first and second tool, wherein each tool has a body and an aperture disposed transversely to the body axis, aligning the apertures of the first and second tools, providing a retaining mechanism comprising a pin and a strap, disposing the pin through the aligned apertures and fastening the strap about the bodies of the first and second tools In yet other embodiments the present disclosure provides a method of using a combination tool assembly to manipulate a work pierce comprising the steps of disposing the bit end of a first tool through the aperture of a second tool, grasping the body of the second tool as a torque handle for manipulation of the first tool, and engaging the bit end of the first tool with a work piece to be manipulated.

DETAILED DESCRIPTION

Generally, the tool includes a body having a first and second end, an aperture disposed transversely through the body and a tool bit disposed at the first or second end to form a bit end of the tool. The tool bit may be integrally formed with the body or may be separately formed from the body and received by the body by a recess located at the first or second end of the body. In a particularly preferred embodiment both the first and second ends comprise a recess that is adapted to receive a tool bit.

Regardless of whether the bits are formed integrally with or separately from the body, it is preferred that the body is elongated and has a longitudinal axis extending along its length. The tool bit at the first or second end of the body are orientated substantially parallel to the longitudinal axis, while the body further comprises an aperture that is generally disposed perpendicularly to the longitudinal axis. In use two tools are operatively connected by disposing the bit end of one tool through the aperture of another, thereby forming a tool having an operative portion and a torque handle.

Figure 1:
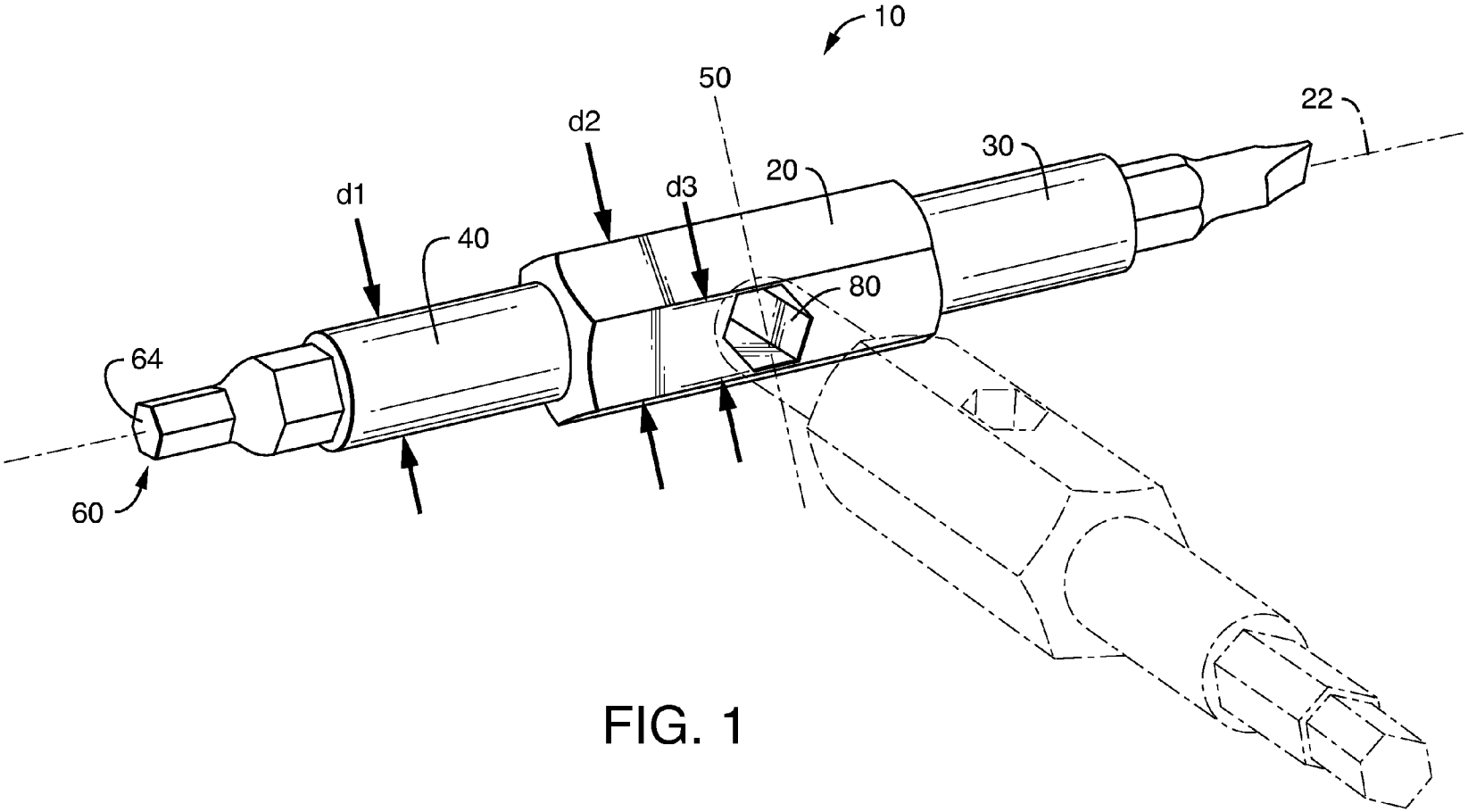
FIG. 1 is a perspective view of a single hand tool.

With reference to FIG. 1, in one embodiment the present disclosure provides a multi-purpose hand tool 10 generally having a body 20 with first 30 and second 40 opposed ends. The body 20 has a midpoint 50 approximately midway between the opposed first 30 and second 40 ends. The body 20 further has an aperture 80 oriented substantially transversely to the axial dimension 22 of the body 20. In the illustrated embodiment the tool is substantially symmetrical about two axis 22 and 50.

With continued reference to FIG. 1, the body 20 includes an aperture 80 aligned to define a passage transverse to the body axis 22. The transversely oriented aperture 80 is disposed between the first and second ends 30, 40, preferably near the midpoint 50 of the body 20. Generally the aperture is shaped to accommodate the bit end or end of a second tool in-use. Thus, in the embodiment illustrated in FIG. 1, the aperture 80 is substantially hexagonal so as to accept one of the hexagonal shaped bits of another tool (phantom lines) in use.

To facilitate its use as a tool at least one end of the tool body is equipped with a tool bit. Generally a bit is received in either end of the tool body by a recess or cavity, also referred to herein as tool bit receiving socket, or simply as a socket. In a particularly preferred embodiment both the first and second ends of the body have a tool bit, however, in other embodiments the present disclosure provides a tool having a bit disposed only at one end.

Figure 2:
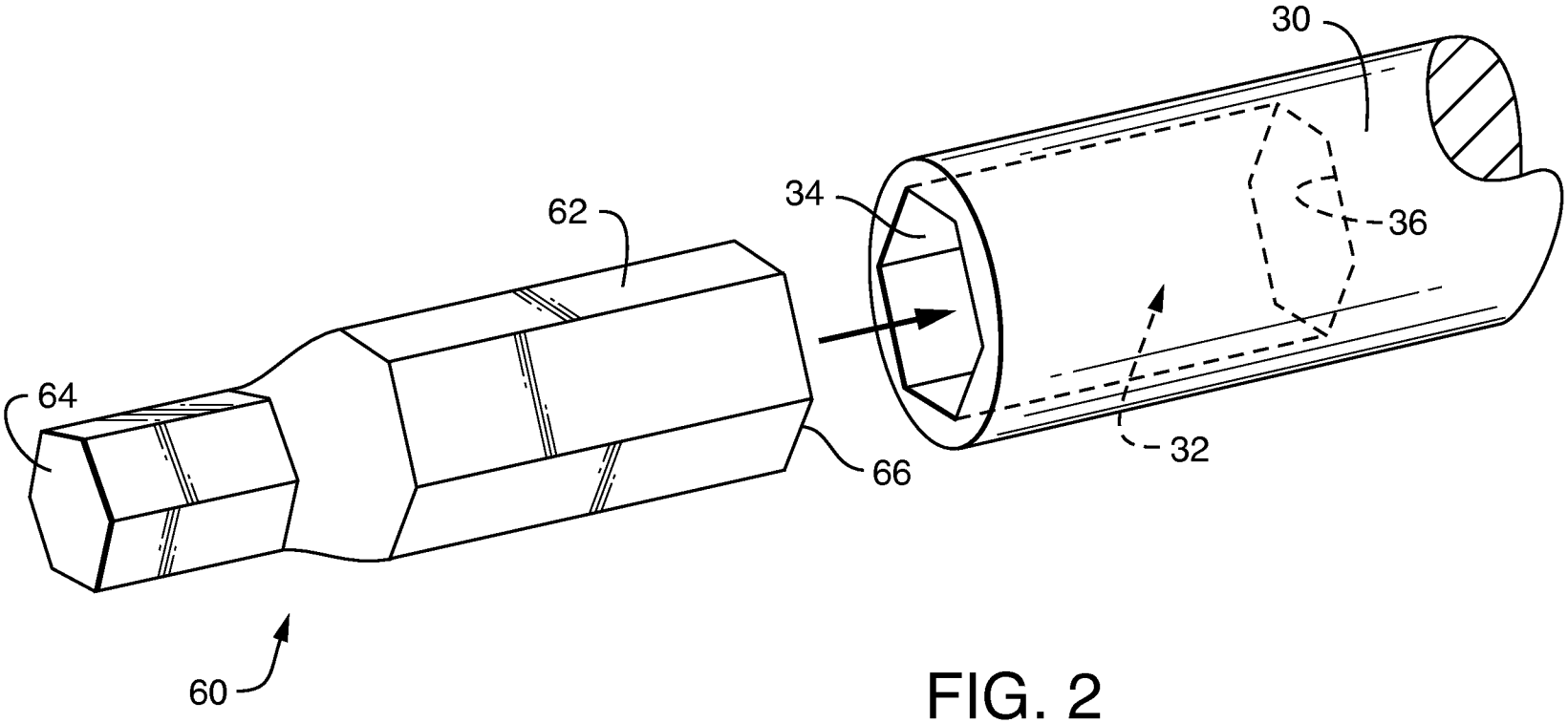
FIG. 2 is a cross-section view of a socket and bit according to one embodiment of the present disclosure.

As illustrated in greater detail in FIG. 2, in a particularly preferred embodiment, the socket 32 at one end of the body 30 has an outwardly opening recess 34 of generally hexagonal cross section, although other cross sections are contemplated, in which the cooperatively configured body portion 62 of the tool bit 60 is seated. When the tool bit 60 is installed in the socket 32, the tool bit end 66 abuts the bottom wall 36 of the socket 34. The work engaging portion 64 of the tool bit 60 extends outwardly of the socket 34, and this will vary in configuration and dimensioning depending upon the tool bit selected for seating therein. The tool bit may be, for example, a Philips head screw driver, a flat head screw driver, a torx, a hexagonal headed driver, socket driver, a corkscrew or the like. As illustrated, the hexagonal cross section of the socket 32 and the hexagonal cross section of the body portion 62 of the tool bit 60 prevent the bit 60 from rotating with respect to the socket 32 and the abutment of the inner end 64 of the tool bit 60 with the socket wall 36 limits the displacement longitudinally into the socket 32.

While socket is illustrated as having a generally hexagonal cross section, the cross sectional shape of the socket may be varied so as to accommodate bits having a wide range of cross section shapes. For example, in certain embodiments the socket has a substantially hexagonal cross section while the bit has a circular cross section. In other embodiments both the socket and the bit may have similar cross sections, such as a hexagonal or a circular cross section.

The socket is conveniently cast into the desired configuration and may be machined to provide a retention means, such as axial ribs or a recess for seating a split ring. While in certain embodiments a socket having a circular cross section may be preferred because of ease of fabrication and assembly, a polygonal or other curvilinear configuration may be employed if so desired and this could minimize the need for axial ribs to prevent relative rotation of the bit. The bit may be secured within the socket by additional means including adhesives and tack welding.

While the illustrated sockets deposed at either end of the tool have end walls designed to prevent the bit from becoming completely recessed in the socket, in other embodiments the body may have an axial socket extending from a first end to a second end thereof. In such instances, to retain the bit against inadvertent disassembly, the socket may be provided with a releasable tool bit retaining means comprising a peripheral groove adjacent the outer end of the wall defining the socket. A resilient split ring is seated in the groove and in a peripheral groove of the tool bit to provide a snap engagement upon insertion of the tool bit into the socket. This prevents the bit from being inadvertently discharged from the socket although the ring may be spread readily when desired to draw the bit outwardly by applying sufficient force to cam the ends of the ring apart.

In still other embodiments, regardless of whether the socket includes an end wall, it may be desirable to include a means for retaining the bit in the socket. Suitable retention means include, resilient O-rings, compressible sleeves, and magnets to provide the desired degree of retention within the socket.

In one particularly preferred embodiment the tool may be fabricated by forming a length of tubular stock of cylindrical configuration to provide circular cross section at one end and expanding the mid-section of the tool to provide a middle portion having an increased diameter. In this manner, the tool has a first and second ends having a first diameter (d1) and a midpoint having a second diameter (d2), wherein d2 is greater than d1.

Although in certain embodiments a body having a circular cross section is preferred because of ease of fabrication and assembly, a polygonal or other curvilinear configuration may be employed. Additionally, the cross section shape of the body may differ between the first and second ends and the midpoint. For example, as illustrated in FIG. 1, the first 30 and second 40 ends may have a circular cross section and the midpoint 50 may have a hexagonal cross section.

While it would be possible for the body to have substantially any cross section, in certain embodiments in may be preferred that the body of the first tool have a cross sectional shape that compliments the shape of the aperture of the second tool. By way of example, the body portion of the first tool may, in certain instances, have either a circular or a non-circular cross section, such as a rounded triangular cross section, a rounded rectangle cross section, or a rounded square cross section. In such instances the shape of the aperture of the second tool is designed accommodate the body of the first tool.

With further reference to FIG. 1, although the body is generally illustrated as having a uniform outer surface, in certain embodiments the body may be machined or otherwise shaped to accommodate gripping of the tool in use, or to provide an additional tool on the body itself. For example, in one embodiment the body may comprise a notch that may be useful as a bottle opener.

In a particularly preferred embodiment (not illustrated) the transversely oriented aperture includes a retention mechanism for retaining the second tool when it is disposed within the aperture of the first tool. For example, a magnet may be disposed adjacent to the aperture such that the magnet acts on the first end of the second tool when it is inserted in the aperture of the first tool. In this manner, the first toll and second tool are fixedly engaged with one another to form a secure tool in-use, preventing the torque handle formed by the second tool from slipping when the user applies force to turn the first tool.

Figure 3:
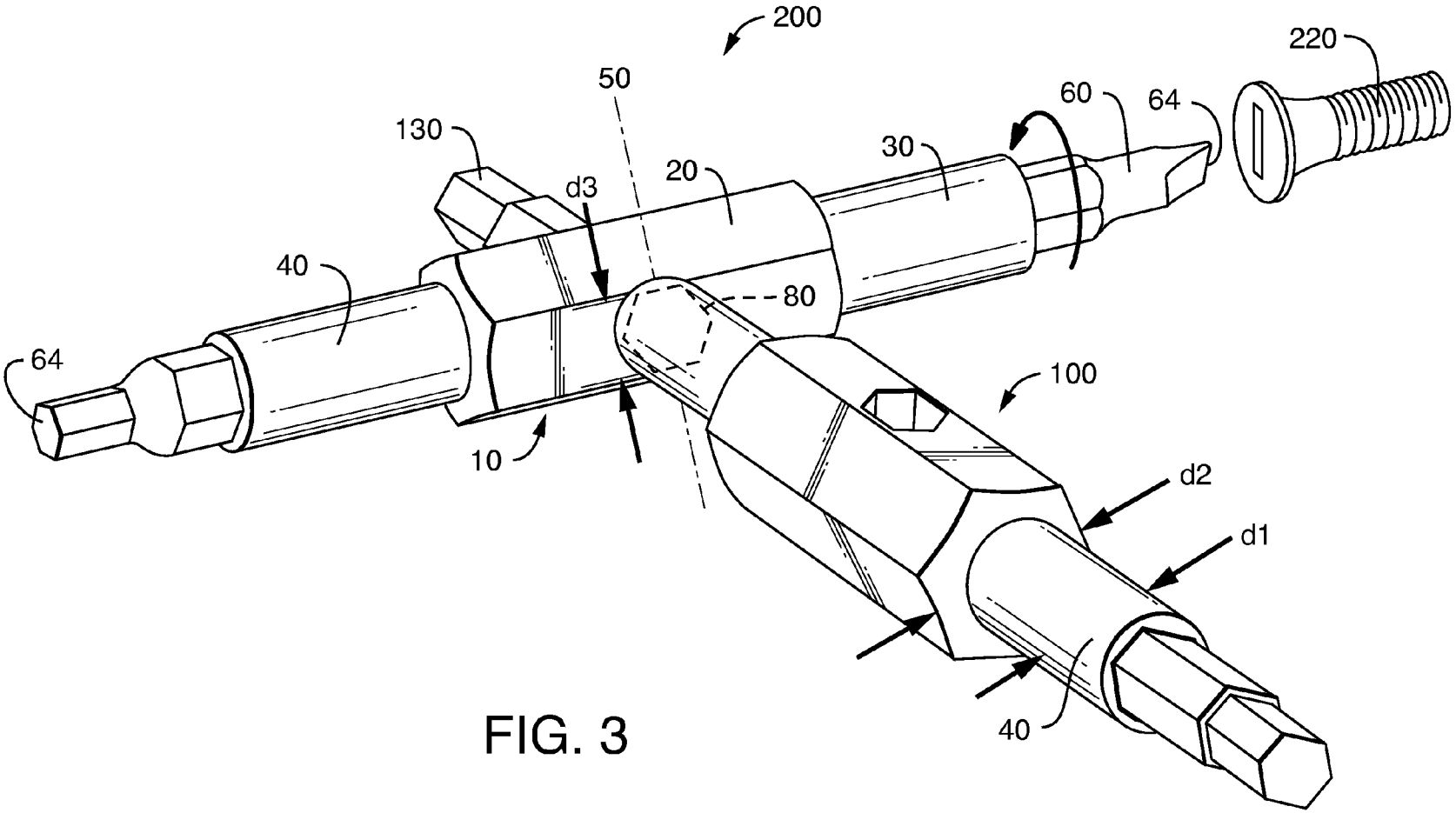
FIG. 3 is a perspective view of two tools in operative association with one another.

Now with reference to FIG. 3, one embodiment of two tools 10, 100 configured for use as a single operative tool 200 is illustrated. In the illustrated embodiment a first tool 10 and a second tool 100 are joined by disposing the bit end 130 of the second tool 100 in the transversely oriented aperture 80 of the first tool 10 to form an operative hand tool where the first tool 10 functions as the working tool and the second tool 100 functions as a torque handle or bar. In this arrangement, it is preferred that the shapes of the bit end 130 of the second tool 100 and the aperture 80 of the first tool 10 are complementary. Another operative tool may be formed by disposing the first or second end of the first tool into the aperture of the second tool. In this manner two tools, having a different bits disposed at each of their ends may be configured so as to form four different tools, wherein in each configuration there is a working tool and a torque handle or bar.

With further reference to FIG. 3, where the first tool 10 has a bit 60 disposed at one end 40, which may be engaged with the work-piece 220. The second tool 100, which forms the torque handle, is disposed through the aperture 80 of the first tool 10. For purposes of using the multi-tool, if the bit 60 at the end 40 of the first tool 10 is to be engaged with a fastener, either end, 130 or 140, of a second tool 100 is disposed in the aperture 80 of the first tool 10 to form a torque handle, which the user may grasp and use to rotate the bit 60 at the end 40 of the first tool 10 once it is engaged with a work-piece 220.

In a particularly preferred embodiment the multi-tool comprises a first and second tool where both tools are substantially the same size and shape and more preferably where both the first and second tools have a first ends having a width dimension (d1), a midsection having a second width dimension (d2), where d2 is greater than d1, and an aperture having a width dimension (d3). In certain embodiments it may be preferred that d3 is greater than d1, but less than d2, so as to permit the joining of the two tools, but preventing the second tool from passing entirely through the aperture of the first tool. In this manner the two tools are removably engageable with one another so as to form a multi-tool having a work-piece engaging end and a torque handle.

Additionally, although it is preferred that the dimension of the mid-section be greater than the dimension of the ends, the present disclosure encompasses a tool where the dimension of the mid-section is equal to the dimension of the ends, as well as embodiments where the dimensions of the ends differ from one another. In other embodiments the dimension (d3) of the aperture may be approximately equal to the dimension of the bit end, but less than the width dimension of the first and second ends (d1) and less than the dimension (d2) of the midpoint of the body. In this embodiment, when two tools are joined by disposing the bit end of one tool in the aperture of the second, the bit passes through the aperture of the second tool, but is stopped when the body end contacts the aperture.

In other embodiments it is preferred that the cross section shape of the bit complement the shape of the aperture. For example, as illustrated in FIG. 3, the bit 130 of the second tool 100 has a substantially hexagonal cross section the aperture 80 of the first tool 10 is also substantially hexagonal. Further, in a particularly preferred embodiment, such as that illustrated in FIG. 3, the dimension of the bit and the aperture are substantially the same so as to provide secure engagement between the tools when the bit end of one tool is inserted in the aperture of another. Also, in other embodiments, the tool end may be sized slightly larger than the aperture to prevent the end from entering the aperture and providing a stop when the tools are arranged in a working relationship.

When not in use, the tool may be stored in a compact form for transportation. To facilitate transportation of multiple tools, the preset disclosure further provides a retention mechanism comprising a strap attached it a pin, which may be inserted into the tool aperture to join multiple tools together. As shown in the embodiment illustrated in FIG. 4, the retention mechanism comprises a fabric strap 120 having a loop portion 122, which secures the strap 120 to a buckle 130, which is in-turn is secured to a pin 140. The strap 120 preferably further comprises one or more apertures 123, that may releasably engaged with the distal end 142 of the pin 140 when the strap 120 is secured around a plurality of multi-tools. The fabric strap may also include a hook portion 124 disposed at the bottom left end of fabric strap 120 functioning to releasably engage a loop portion 126.

In certain embodiments, the pin 140 may be machined at one end 142 to include a notch 144 that may be used as a spoke wrench. Clearance for the spokes may be provided by a cavity 146 running the length of the pin 140. Further, the buckle 130, which secures the pin 140 to the strap 120, may be curved slightly to further provide clearance for the spokes and to accommodate it use as a lever for turning the pin 140 when the notch 144 is engaged with the nipple of a spoke.

Figure 4:
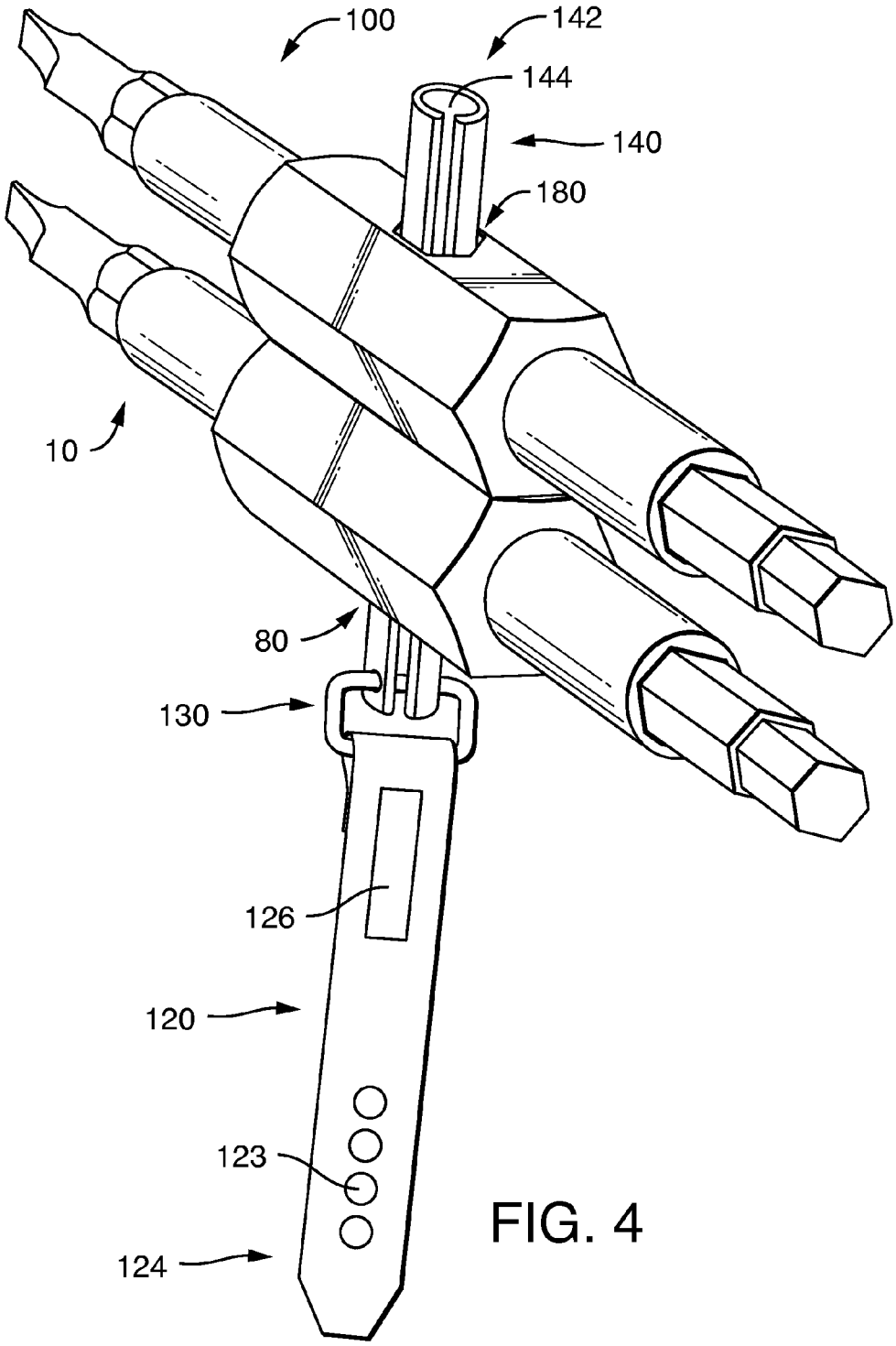
FIG. 4 is a perspective view of two tools joined together by a retention mechanism

To join two or more multi-tolls together, as illustrated in FIG. 4, the apertures 80, 180 of two multi-tools 10, 100 are aligned and the distal end 142 of the pin 140 is inserted there-through. The fabric strap 120 is then laid over the pair of tools 10, 110 and pin 140 is inserted into one of the strap apertures 123. The remaining portion of the strap is secured by joining the hook portion 124 disposed at the bottom left end of fabric strap 120 to the loop portion 126. In other embodiments, two or more multi-tolls may be aligned side-by-side and secured using a strap or an O-ring. In this manner two, three, four, five, or more tools may be joined together to provide a compact, generally rectangular configuration.

The combination tool assembly may also include one or more tire levers, which may be formed of a suitable plastic material, metal, or the like. The tire levers may be shaped as those described in U.S. Pat. No. 5,979,532, the disclosure of which is incorporated herein by reference. The tire lever has an elongated, generally rectangular body with a curved, reduced-thickness tip at one end thereof. The tire lever may also include slanted, spoke-engaging slots formed in the opposite side edges of the body.

In a particularly preferred embodiment, the disclosure provides a combination tool comprising two multi-tools, as described herein, a pair of tire levers and a retention mechanism, where the two multi-tools are arranged side-by-side and the tire lever is disposed on top of the arranged multi-tools. The pair of multi-tools and the tire lever are secured together by the retention mechanism. In this manner it is preferred that the multi-tools are approximately equal in size and both are shaped such that the diameter of the midsection is greater than the diameter of either end and further that the length of the tools is approximately the same length as the tire lever.

Although the invention has been explained in relation to its preferred embodiment, it is to be understood that many other possible modifications and variations can be, made without departing from the scope of the invention as hereinafter claimed. Moreover, while the multi-tool described herein has generally been described as being particularly useful for the repair and maintenance of a bicycle, its use is not so limited. The multi-tool described herein is well suited for use in a variety of applications and may be used to fasten and adjust a variety of fasteners and the like.

What is claimed is:

1. A tool kit comprising two multi-purpose hand tools and a retention mechanism, wherein each tool comprises a body having a first end and a second end, the first or second end having a tool bit receiving socket and a tool bit disposed within the socket, and an aperture extending transversely through the body wherein the two multi-purpose hand tools are of substantially the same size and shape;

wherein the retention mechanism comprises a retention pin having a first and second end, a loop disposed at the first end and a band attached to the loop and the retention pin is disposed in the transverse bore of both tools when said kit is in its stowed position;

wherein the tool bits of the two multi-purpose tool each have a cross-section which is of the same shape and substantially the same size as the apertures of the two multi-purpose tools; and and wherein the rotation of the first tool while temporarily and selectively connected to the second tool creates torque capable of rotating the second tool.

2. The multi-purpose hand tool of claim 1 wherein the first and second ends of the first tool and the first and second ends of the second tool have a bit receiving socket and a tool bit disposed within the socket.

3. The multi-purpose hand tool of claim 1 wherein the first and second ends of the first and second tools both have a substantially circular cross section.

4. The multi-purpose hand tool of claim 3 wherein the first and second ends of the first tool and the second tool each have a first dimension (d1) and the midpoint of the body has a second dimension (d2) and, where d1 is less than d2.

5. The multi-purpose hand tool of claim 1 wherein the tool bit of the first or second tool comprises a body portion and a work engaging portion selected from the group consisting of a Philips head screw driver, a flat head screw driver, a torx, and a hexagonal headed driver.

6. A tool kit comprising two multi-purpose hand tools and a retention mechanism, wherein each tool comprises a body having a first end and a second end, the first or second end having a tool bit receiving socket and a tool bit disposed within the socket, and an aperture extending transversely through the body;

wherein the retention mechanism comprises a retention pin having a first and second end, a loop disposed at the first end and a band attached to the loop;

wherein the retention pin is disposed in the transverse bore when said kit is in its stowed position; and wherein the retention pin further comprises a connecting slot formed the second end wherein the connecting slot is shaped to receive a spoke nipple.

* * * * *